US009486113B2

(12) United States Patent
Zimbric

(10) Patent No.: US 9,486,113 B2
(45) Date of Patent: Nov. 8, 2016

(54) BATHTUB APRON ASSEMBLY

(71) Applicant: Kohler Co., Kohler, WI (US)

(72) Inventor: Luke Benjamin Zimbric, Saukville, WI (US)

(73) Assignee: KOHLER CO., Kohler, WI (US)

( * ) Notice: Subject to any disclaimer, the term of this patent is extended or adjusted under 35 U.S.C. 154(b) by 233 days.

(21) Appl. No.: 14/206,566

(22) Filed: Mar. 12, 2014

(65) Prior Publication Data

US 2014/0259362 A1 Sep. 18, 2014

Related U.S. Application Data

(60) Provisional application No. 61/793,529, filed on Mar. 15, 2013.

(51) Int. Cl.
*A47K 3/02* (2006.01)
*A47K 3/16* (2006.01)

(52) U.S. Cl.
CPC *A47K 3/161* (2013.01); *A47K 3/16* (2013.01)

(58) Field of Classification Search
CPC ..... A47K 3/161; A47K 3/16; A47K 3/03
USPC ..... 4/584, 548, 592, 593, 594, 595, 559
See application file for complete search history.

(56) References Cited

U.S. PATENT DOCUMENTS 2,841,795 A * 7/1958 Pelicano ..... A47K 3/02 4/592
3,028,603 A * 4/1962 Rodman ..... A47K 3/161 4/559
3,257,669 A * 6/1966 Fay ..... A47K 3/008 4/559
3,561,019 A * 2/1971 Roland ..... A47K 3/16 4/593
3,827,086 A * 8/1974 Seymour ..... A47K 3/16 4/584
4,067,071 A * 1/1978 Altman ..... A47K 3/008 4/546
4,551,869 A * 11/1985 Whitney ..... A47K 3/17 4/589
5,241,713 A * 9/1993 Wang ..... A47K 3/1605 4/593
5,263,208 A * 11/1993 Smith ..... A47K 3/284 4/596
5,430,898 A * 7/1995 Wang ..... A47K 3/161 4/592
5,477,568 A * 12/1995 Wang ..... A47K 3/16 4/592
5,864,898 A * 2/1999 Knapp ..... A47K 3/161 4/584
D547,832 S * 7/2007 Kohler, Jr. ..... D23/277
2005/0097667 A1* 5/2005 Torres ..... A47K 3/161 4/584
2007/0033728 A1* 2/2007 Sisk ..... A47K 3/1615 4/584
2009/0255050 A1* 10/2009 Lebrun ..... A47K 3/161 4/584
2011/0072576 A1* 3/2011 Brunelle ..... A47K 3/16 4/592

* cited by examiner

*Primary Examiner* — J. Casimer Jacyna
*Assistant Examiner* — Benjamin R Shaw
(74) *Attorney, Agent, or Firm* — Foley & Lardner LLP

(57) ABSTRACT

An apron assembly may be designed for a bathtub having an above-floor drain. The apron assembly may include an apron attached to an upper surface of the bathtub, an apron extension which snaps onto a bottom portion of the apron, and an apron cover that snaps onto a front surface of the apron extension.

17 Claims, 8 Drawing Sheets

BATHTUB APRON ASSEMBLY

CROSS-REFERENCE TO RELATED PATENT APPLICATIONS

This application claims the benefit of U.S. Provisional Application No. 61/793,529, filed on Mar. 15, 2013, incorporated herein by reference in its entirety.

BACKGROUND

The present disclosure relates generally to the field of bathtubs, and more particularly to an apron for a bathtub.

A bathtub that is not mounted within a mounting platform or a mounting surface, may include an apron on one end of the bathtub. An apron for a bathtub may be used conceal a basin of the bathtub, or to prevent water from leaking into an area below the basin of the bathtub.

SUMMARY

An exemplary embodiment relates to an apron assembly for a bathtub having an above-floor drain. The apron assembly includes an apron that is coupled to an upper surface of the bathtub, wherein a bottom end of the apron includes a lip. The apron assembly also includes an apron extension that is configured to couple to the lip of the apron in a snap-fit fashion, and an apron cover that is configured to couple to a front surface of the apron extension in a snap-fit fashion.

Another exemplary embodiment relates to an apron assembly for a basin having an above-floor drain. The apron assembly includes an apron having a prescribed height, the prescribed height being less than or equal to a height of the basin, as measured between a bottom surface of the basin and a rim of the basin. The apron assembly also includes an apron extension configured to couple to a bottom portion of the apron when the apron is coupled to the basin. The apron extension supports the weight of the apron when coupled thereto.

Yet another exemplary embodiment relates to a bathtub assembly. The bathtub assembly includes a basin which is at least partially defined by a bottom wall and a side wall. The bathtub assembly also includes an apron assembly and an above-floor drain. The apron assembly includes an apron having a prescribed height. The basin includes a rim extending radially outward from the side wall. The apron is configured to couple to a portion of the rim, and the above-floor drain may be coupled to the bottom floor of the basin after the apron is coupled to the rim and after the bathtub is mounted to the floor.

DETAILED DESCRIPTION

Figure 1:
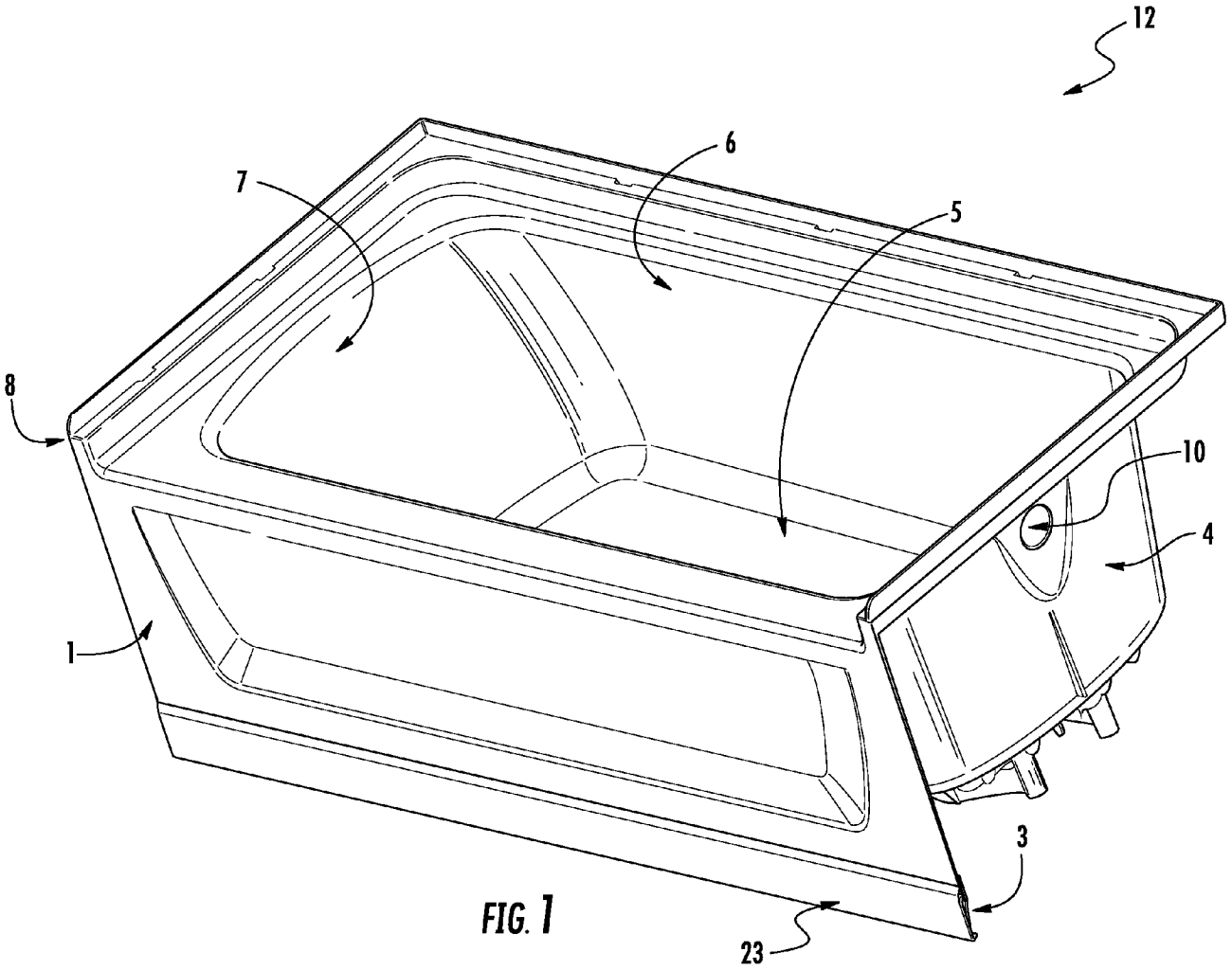
FIG. 1 is a perspective view of a bathtub having an apron assembly according to an exemplary embodiment.
Figure 2:
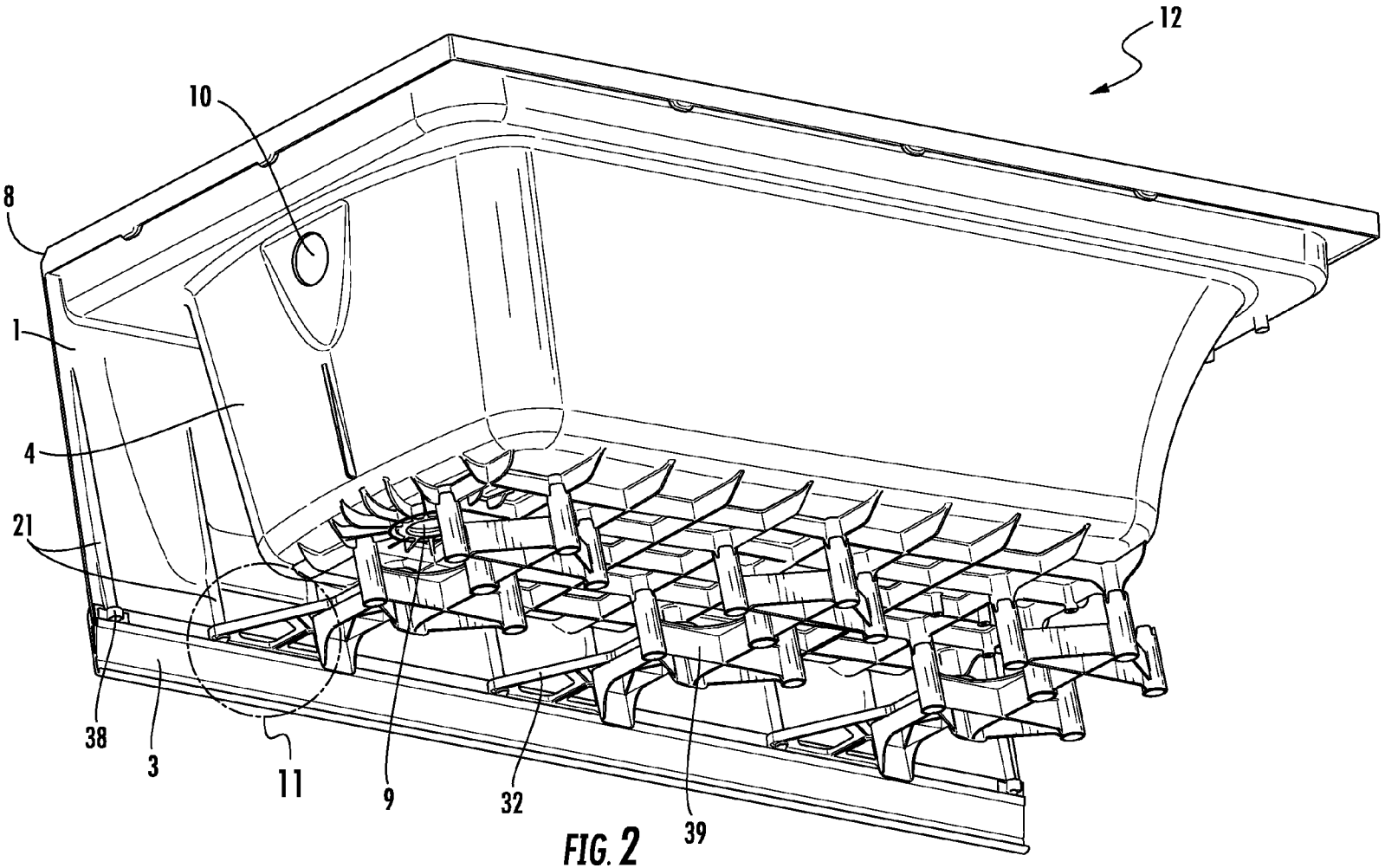
FIG. 2 is another perspective view of the bathtub and apron assembly shown in FIG. 1.

Referring to FIGS. 1-2, according to an exemplary embodiment, a bathtub 12 includes a basin 4 which is defined by a bottom wall 5, two side walls 6, and two end walls 7. An upper portion of the side walls 6 and the end walls 7 includes a rim 8 that extends radially outward from the basin 4. The rim 8 may be configured to couple to a plurality of panels that comprise a shower enclosure. For example, the rim 8 may be configured so a plurality of panels may rest thereon. The bottom wall 5 of the basin 4 includes a drain hole 9, and one of the end walls 7 may include a hole 10 configured to receive a water supply. The basin 4 may be made out of several materials, including, for example, fiberglass-reinforced plastic, enameled steel, cast iron, and any other suitable material. While FIGS. 1-2 illustrate a particular bathtub having walls of a relative size, it should be understood that other bathtubs may have walls of varying sizes, according to other exemplary embodiments.

Referring to FIGS. 1-2, according to an exemplary embodiment, an apron 1 may be a generally planar and relatively thin wall that is coupled to the rim 8. The apron 1 may be made, for example, from a polymeric material, a composite material, or any other suitable material. Various design or aesthetic features (i.e., curved portions, grooves, recessions, protrusions, projections, etc.) may be formed on either a front or back surface of the apron 1 to provide it with structural support.

According to an exemplary embodiment, an upper portion of the apron 1 is configured to couple to a portion of the rim 8 which is adjacent one of the side walls 6. The apron 1 may extend downward from the rim 8 toward a floor when the bathtub is mounted on the floor. Further, the apron 1 may extend downward from the rim 8 to a prescribed length. In other words, a height of the apron 1 may be defined by the prescribed length. The prescribed length of the apron 1 may be less than or equal to a height of the basin 4, as measured between the bottom surface of the basin 4 and the rim 8. According to an exemplary embodiment, a bottom portion of the apron 1 includes a lip 13 (not shown in FIGS. 1-2, but see, e.g., FIGS. 6-7) that is curved radially outward (e.g., extends in a lateral direction) relative to the basin 4 when the apron 1 is coupled thereto.

According to an exemplary embodiment, the apron 1 is integrally formed with the rim 8 of the bathtub 12. According to other exemplary embodiments, fasteners or an adhesive may be used to couple the apron 1 to the rim 8. According to other exemplary embodiments, the apron 1 may be configured to be removably coupled to the rim 8. It should be understood that a variety of methods may be used to couple an apron to the rim of the bathtub disclosed herein, according to other exemplary embodiments.

Figure 3:
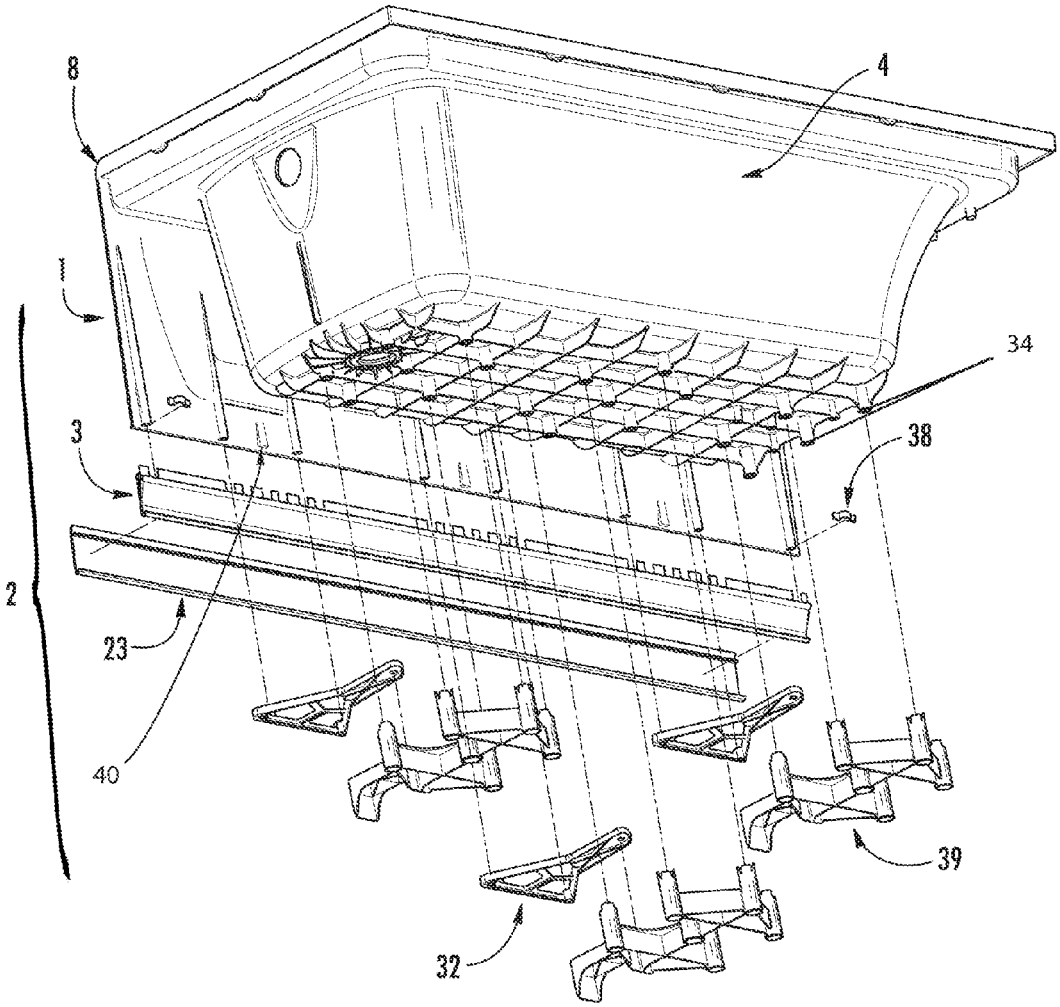
FIG. 3 is an exploded perspective view of the bathtub and apron assembly shown in FIG. 1, according to an exemplary embodiment.

As shown in FIGS. 1-3, and according to an exemplary embodiment, the bathtub 12 includes an apron assembly 2 that comprises the apron 1, an apron extension 3, an extension cover 23, a plurality of wedge members 32, a plurality of undersupport members 39, and a plurality of end clips 38. Advantageously, the apron assembly 2 disclosed herein may be used to conceal an exterior of the basin 4, as well as the bathroom floor underneath and around the basin 4. Also, the apron assembly 2 may be used to prevent water from leaking past the apron assembly and toward the exterior of the basin 4 and the area underneath and around the basin 4.

According to an exemplary embodiment, the apron assembly 2 allows the bathtub 12 to be coupled to an above-floor drain, or an in-floor drain. When the bathtub 12 is coupled to an above-floor drain, the apron assembly 2 may be assembled to the bathtub 12 in order to provide the necessary clearance for the above-floor drain to be coupled between the floor and the drain hole 9. When the bathtub 12 is coupled to an in-floor drain, it may not be necessary to assemble the apron assembly 2 to the bathtub in order to mount the bathtub 12 to a floor and couple the in-floor to the drain hole 9.

Figure 11:
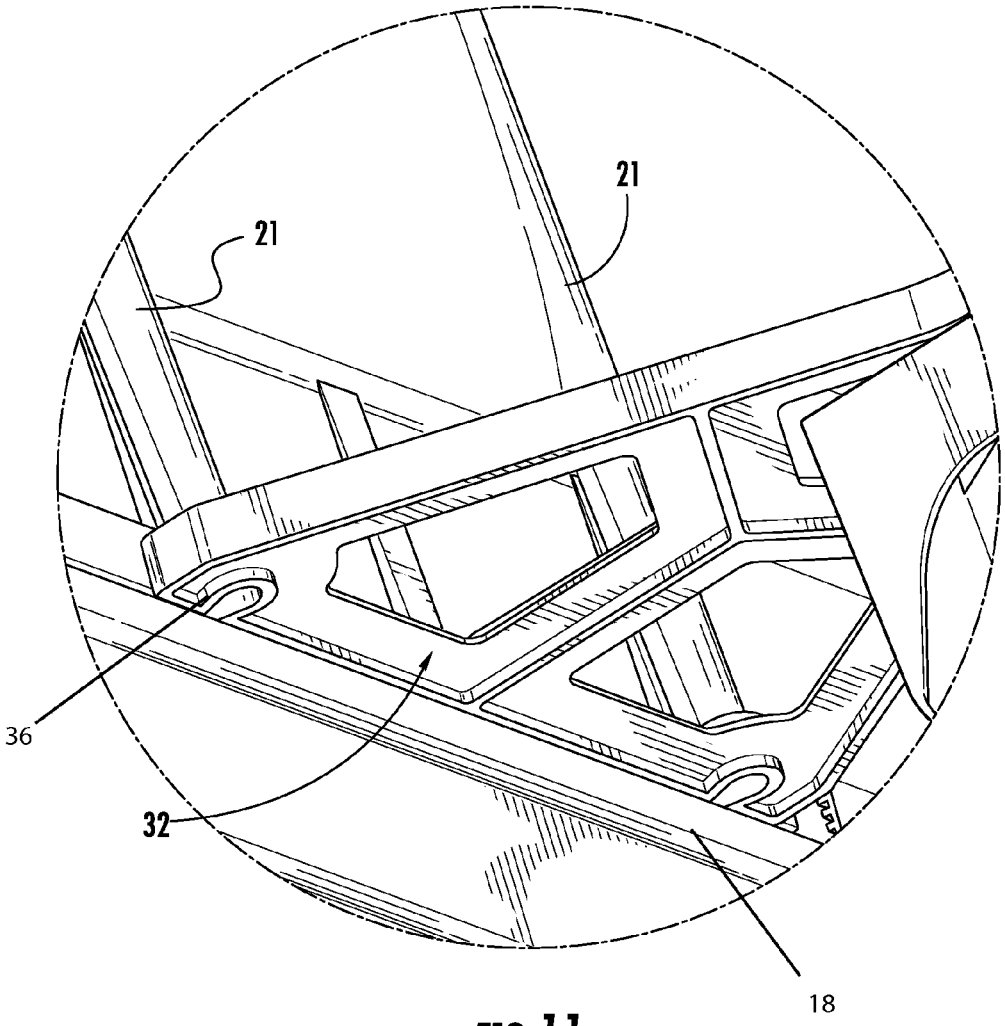
FIG. 11 is a detailed view of a portion of the bathtub of FIG. 2 according to an exemplary embodiment.

As shown in FIG. 2, and more particularly in FIG. 11, a plurality of vertical flanges 21 (e.g., projections, ribs, etc.) may be integrally formed onto or coupled to a rear side of the apron 1, thus providing the apron 1 with structural support. The vertical flanges 21 may extend vertically along a portion of the rear side of the apron 1 to a bottom edge of the apron 1. Each vertical flange 21 may have a cross-section that is configured to retain a notch (i.e. an opening, slot, cavity, etc.) of the wedge pieces 32 or the end clips 38. For example, as shown in FIG. 11, the vertical flange 21 has a generally "tear-shaped" or "pear-shaped" cross-section in which a wider portion of the cross-section is spaced apart from the apron 1 by a narrower portion. Accordingly, an opening of the notch of the wedge pieces 32 or the end clips 38 may correspond to the cross-section of the vertical flanges 21, enabling the vertical flange 21 to retain the wedge piece 32 or the end clip 38 when coupled thereto (e.g., in a snap-fit fashion).

Figure 4:
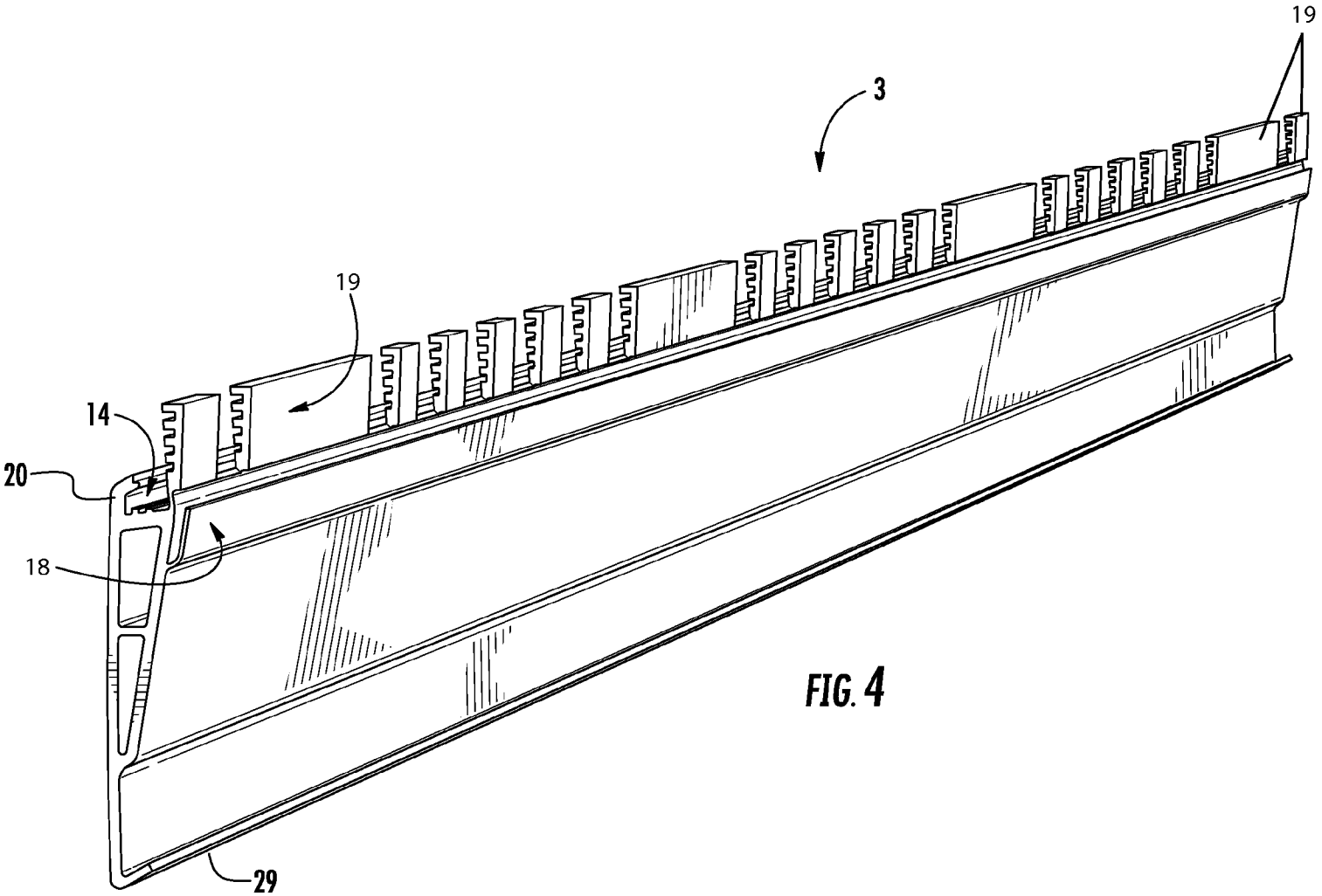
FIG. 4 is a perspective view of an apron extension for an apron assembly.

Referring to FIG. 4, according to an exemplary embodiment, the apron extension 3 is configured to couple to a bottom portion of the apron 1. The apron extension 3 may be used to conceal the exterior of the basin 4 from view. The apron extension 3 may also be used to support the weight of the apron 1 when coupled thereto. According to an exemplary embodiment, the apron extension 3 is made from an extruded polymeric material. According to other exemplary embodiments, the apron extension 3 may be made from any suitable material, and any suitable manufacturing process may be used to form the apron extension 3.

According to an exemplary embodiment, the apron extension 3 includes a receiving pocket 14 (e.g., a channel, recess, groove, etc.) that is configured to receive and couple to the lip 13 (see, e.g., FIGS. 6-7) of the apron 1. The receiving pocket 14 is positioned along a top portion of the apron extension 3, and may extend along the length of the apron extension 3. The receiving pocket 14 is defined on a front side by a front locking member 20, on a bottom side by a bottom surface, and on a rear side by a flexible rear support 19 (see also, e.g., FIGS. 6-7). Further, an opening of the receiving pocket 14 may be defined between the front locking member 20 on a front side and the rear support 19 on a rear side.

As shown in FIGS. 3-4, according to an exemplary embodiment, the rear support 19 of the apron extension 3 is configured to be coupled to and/or engage the back surface of the apron 1. A plurality of vertical slots (e.g., notches, openings, slits, etc.) may be disposed along the length of the rear support 19, and the slots may be positioned in order to receive the vertical flanges 21 therebetween when the apron extension 3 is coupled to the apron 1. Therefore, the vertical slots of the rear support 19 and the vertical flanges 21 of the apron 1 may be used to position the apron extension 3 relative to the apron 1. While the apron extension 3 is shown in the figures as having various features of a relative size, orientation, length, thickness, shape, etc., it should be understood that the apron extension as described herein may be configured in other ways, according to other embodiments.

Figure 6:
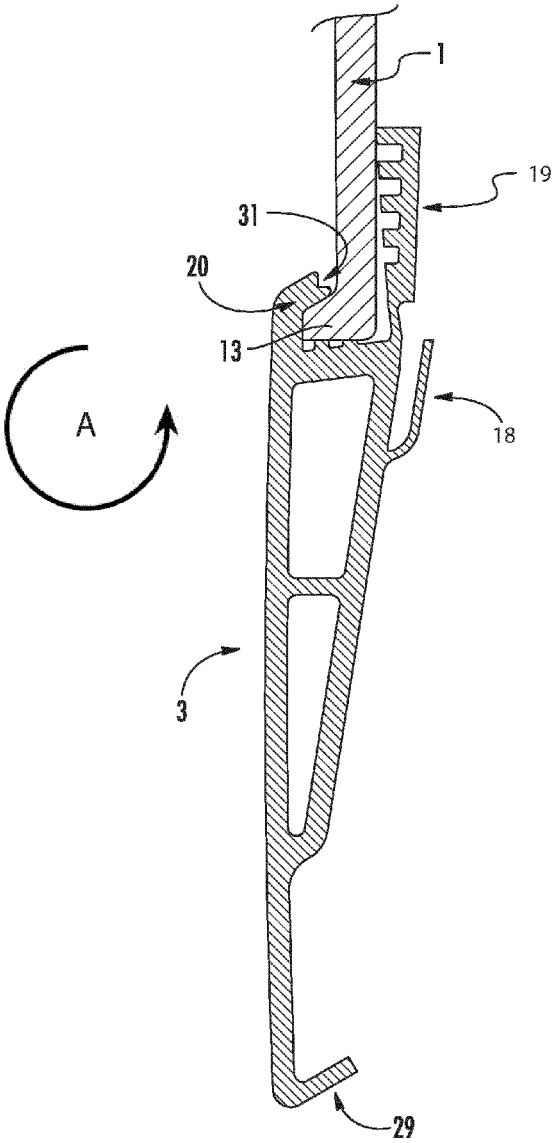
FIG. 6 is a cross-sectional view of an apron extension for an apron assembly.
Figure 7:
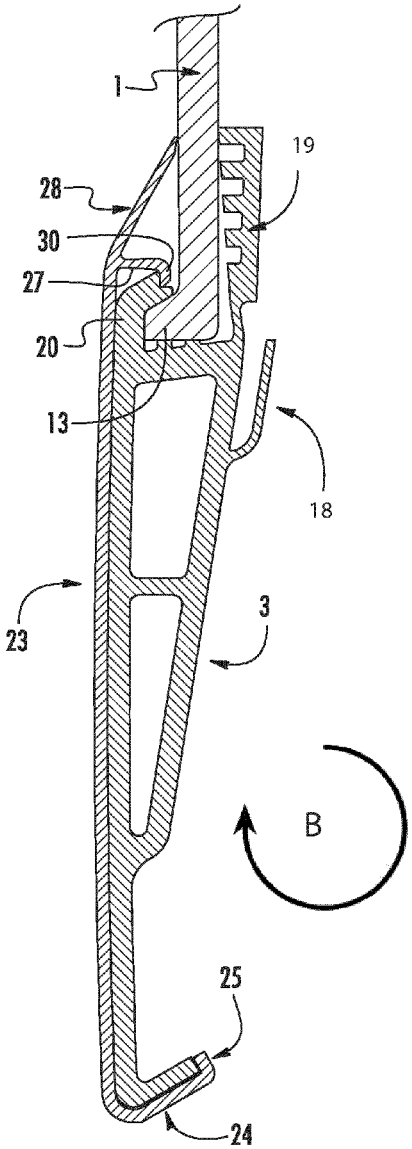
FIG. 7 is a cross-sectional view of an apron extension and extension cover, according to an exemplary embodiment.

According to an exemplary embodiment, in order to install the apron extension 3 onto the apron 1, the apron extension 3 is first oriented so that the bottom surface of the receiving pocket 14 is generally facing a front surface of the apron, and the lip 13 is positioned within the opening of the receiving pocket 14 so that the rear support 19 is on a bottom side of the lip 13 and the front locking member 15 is on a top side of the lip 13. The apron extension 3 is then brought (e.g., moved) toward the apron 1 until the lip 13 interfaces (e.g., engages) with the bottom surface of the receiving pocket 14. Then, the apron extension 3 is pivoted in a direction "A" (shown in FIGS. 6-7), until the rear support 19 of the apron extension 3 interfaces with and/or engages the rear surface of the apron 1 and the lip 13 is seated within the receiving pocket 14, as shown in FIGS. 6-7. The rear support 19 may be configured to bend (e.g., flex, etc.) in a rearward direction to further facilitate the assembly of the apron extension 3 onto the apron 1. According to an exemplary embodiment, in order to retain the apron within the apron extension, the width of the opening of the receiving pocket 14 is less than the width of the lip 13 (e.g., as measured between a front and rear surface of the lip 13) of the apron 1 when the apron extension 3 is coupled to the apron 1.

Referring to FIG. 3, according to an exemplary embodiment, a plurality of angled members 40 (e.g., projections, etc.) are formed on a bottom portion of the rear surface of the apron 1. As shown in FIG. 3, in one embodiment the position of the angled members 40 is between two vertical flanges 21. The angled members 40 extend in a rearward direction away from the rear surface of the apron 1. Further, an outer surface of the angled members 40 is formed at an angle, relative to the rear surface of the apron 1. In other words, the cross-section of each angled member 40 (as viewed from a left or right side of the angled member) is narrower at a top end and wider toward a bottom end.

According to an exemplary embodiment, the angled members 40 may be configured to resist a movement of the apron extension 3 relative to the apron 1. For example, in the event the apron extension 3 is forced away from the apron 1 (e.g., in a direction away from the rim 8), the angled members 40 may be configured to interface with the rear supports 19 of the apron extension. The interaction between the angled members 40 and the rear supports 19 may resist a movement of the apron extension 3 away from the apron 1.

Referring to FIGS. 4-7, according to an exemplary embodiment, the apron extension 3 and the extension cover 23 are configured to be coupled together (e.g., in a snap-fit fashion or similar manner). In particular, the apron extension 3 and the extension cover 23 include several features that are configured to interact in order for the apron extension 3 to retain the extension cover 23. When the extension cover 23 is coupled to the apron extension 3, a rear face of the extension cover 23 faces a front face of the apron extension 3.

Figure 5:
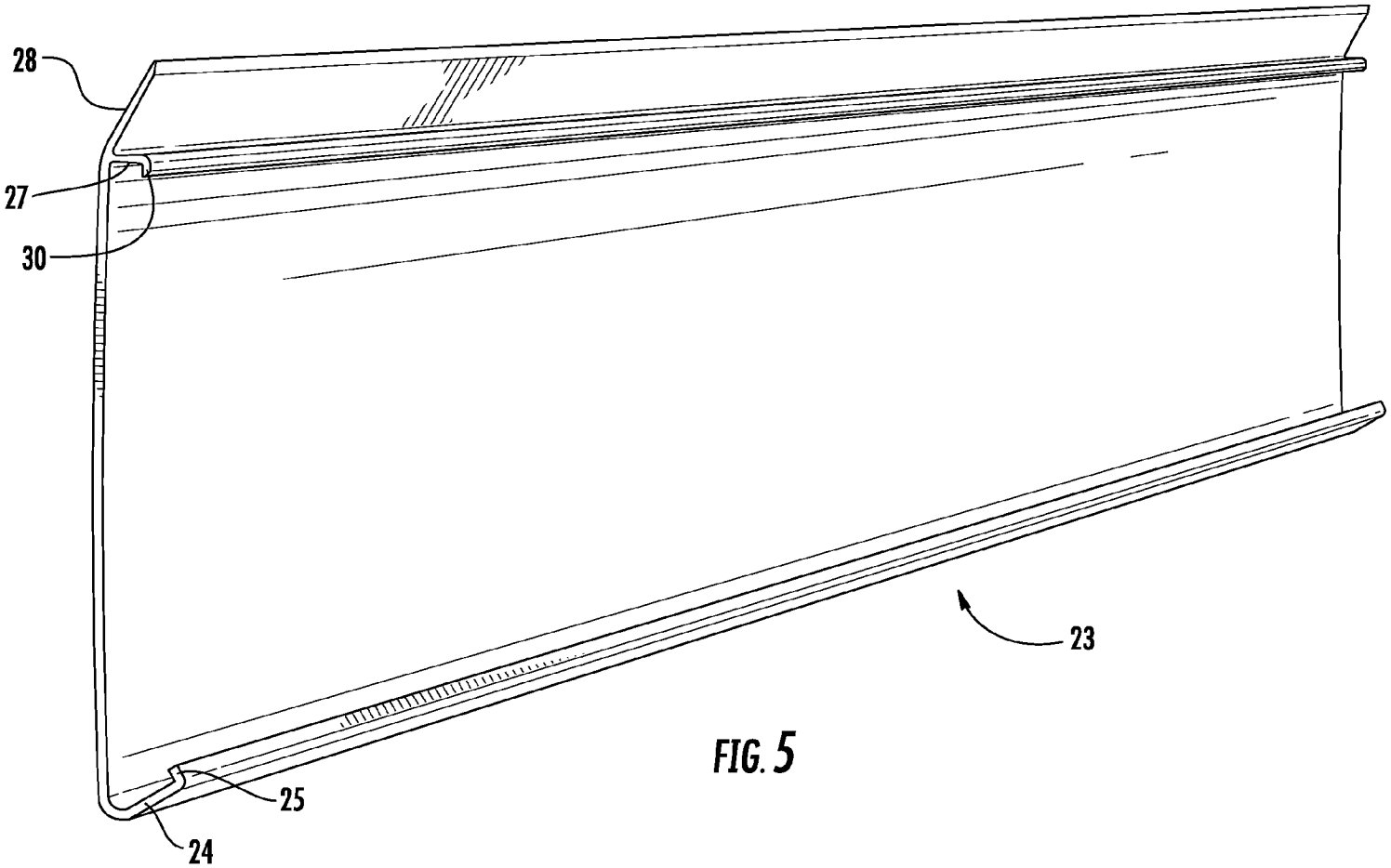
FIG. 5 is a perspective view of an extension cover according to an exemplary embodiment.

Referring to FIGS. 5 and 7, according to an exemplary embodiment, an upper flange 27 extends away from a rear surface of the extension cover 23, proximate a top end of the extension cover 23. The upper flange 27 may be integrally formed along the length of the extension cover 23. A lip 30 is integrally formed on an end of the upper flange 27, and curves or extends generally downward from an end of the upper flange 27.

Referring to FIG. 6, an inside corner 31 (e.g., a recess, notch, elongated portion, etc.) is formed along a top end portion of the upper locking member 20. The inside corner 31 includes a forward facing surface that is faced toward the rear support 19. As shown in FIG. 7, the forward facing surface of the inside corner 31 is configured to abut against the lip 30 of the extension cover 23. According to an exemplary embodiment, as shown in FIG. 7, the lip 30 of the extension cover 23 is configured to be received within a space defined between the inside corner 31 on a first side and the apron 1 on a second side, when the apron extension 3 is coupled to the apron 1. Further, an angle defined between a forward facing surface and a bottom surface of the inside corner 31 may be less than 90 degrees, in order to promote better retention of the extension cover 23.

Referring to FIGS. 4 and 6, according to an exemplary embodiment, a bottom flange 29 is formed along a bottom end of the apron extension 3. The bottom flange 29 extends in a generally rearward direction (the rearward direction being away from the rear surface of the extension cover 23). The bottom flange 29 may extend upwards at approximately a 45 degree angle.

Referring to FIGS. 5, and 7, according to an exemplary embodiment, a bottom flange 24 is formed along a bottom end of the extension cover 3. The bottom flange 24 extends in a generally rearward direction, and the bottom flange 24 may extend upwards at approximately a 45 degree angle. A lip 25 is formed on an end of an angled portion of the bottom flange 24, and the lip 25 extends and/or curves upwards (i.e., curved upwards toward the upper flange 27 of the extension cover 23). The bottom flange 24 of the extension cover 23 is configured to couple to the bottom flange 29 of the apron extension 3. While the extension cover 23 is shown in the figures as having various features of a relative size, orientation, length, thickness, shape, etc., it should be understood that the extension cover as described herein may be configured in other ways, according to other embodiments.

As shown in FIGS. 1-2 and 7, according to an exemplary embodiment, once the apron extension 3 has been assembled onto the apron 1, the extension cover 23 may be coupled to the apron extension 3. In order to couple the extension cover 23 to the apron extension 3, the bottom flange 29 of the apron extension 3 is first received by the bottom flange 24 of the extension cover 23, so that an end surface of the bottom flange 29 abuts an inside corner of the lip 25. The extension cover 23 is then pivoted in a direction "B" (see FIG. 7), until a rear surface of the extension cover 23 interfaces with a front surface of the apron extension 3 and the lip 30 abuts against the forward facing surface of the inside corner 31 of the front locking member 20 of the front locking member 20.

Referring to FIGS. 5 and 7, according to an exemplary embodiment, an angled flange 28 is formed along a top portion of the extension cover 23. When the extension cover 23 is coupled to the apron extension 3 and the apron 1, the angled flange 28 extends upward at an angle from a top portion of the extension cover proximate the flange 27 to the apron 1. When the extension cover 23 is coupled to the apron extension 3, the angled flange 28 is configured to interface with the apron 1. Therefore, the apron extension 3 and the extension cover 23 may be used in combination to support the apron 1.

According to various exemplary embodiments, the extension cover 23 may be used to conceal the mating surfaces between the apron 1 and the apron extension 3. The extension cover 23 may also be used to lock the apron 1 within the receiving pocket 14 of the apron extension 3. The extension cover 23 may also provide greater stability to the apron extension 3 and/or support the weight of the apron 1. In addition, the extension cover 23 may be used to improve the aesthetics of the apron assembly 2.

Referring to FIG. 4, according to an exemplary embodiment, a flange 18 is formed on a rear side of the apron extension 3. The flange 18 is formed along the length of the apron extension 3, and as shown in FIG. 4, the flange 18 extends outward from the rear side of the apron extension 3, and curves upward towards the rear supports 19. As shown in FIG. 6, an end of the flange 18 is approximately horizontally aligned with the bottom surface of the receiving pocket 14 and/or a bottom portion of the rear supports 19. According to an exemplary embodiment, as shown in FIG. 11, the flange 18 may be configured to position the wedge pieces 32 and/or the end clips 38 on the rear side of the apron extension. The flange 18 may also be configured to support the weight of the wedge pieces 32 and the end clips 38 when coupled thereto.

Figure 9:
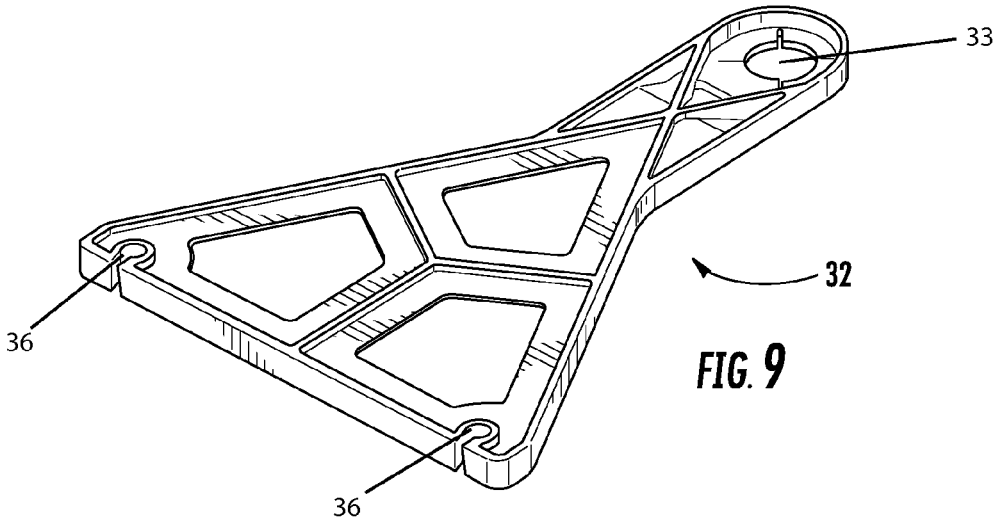
FIG. 9 is a perspective view of a wedge piece for an apron assembly.

As shown in FIGS. 2 and 9, according to an exemplary embodiment, the apron assembly 2 for the bathtub 12 includes at least one wedge piece 32. The wedge piece 32 may be used to force the apron extension 3 against the apron 1, in order to retain the apron 1 within the apron extension 3. The wedge piece 32 may also be used to restrict the horizontal and vertical movement of the apron extension 3 relative to the apron 1 and to retain the apron extend 3 in proper position.

Referring to FIG. 9, according to an exemplary embodiment, each wedge piece 32 includes a front portion and a rear portion. The rear portion of each wedge piece 32 includes an aperture 33 (e.g., hole, opening, etc.). The aperture 33 of each wedge piece 32 is configured to be received by one of a plurality of bosses 34 (e.g., projections, protrusions, members, etc.) which are disposed on a bottom surface of the basin 4. Each wedge piece 32 may be coupled to the bathtub 12, for example, with a fastener through the aperture 33 and the boss 34. It should be understood that the wedge piece described in the exemplary embodiments herein may include other features that are used to couple the wedge piece to a bathtub, and that other methods may be used to couple the wedge piece to a bathtub, according to other embodiments.

Referring to FIGS. 9 and 11, according to an exemplary embodiment, the front portion of each wedge piece 32 includes at least one vertical notch 36 (e.g., recess, etc.). Each vertical notch 36 of the wedge piece 32, may be configured to receive the vertical flange 21 of the apron 1. When the apron extension 3 is coupled to the apron 1, the wedge pieces 32 are configured to couple to the rear support 19 of the apron extension 3, and the vertical notches 36 of each wedge piece 32 are configured to receive the vertical flanges 21 of the apron 1. Therefore, the wedge pieces 32 are configured to force the apron extension 3 against the apron 1, and thereby retain the apron extension 3 and the extension cover 23 to the apron 1.

Figure 10:
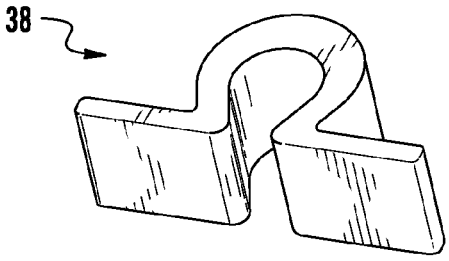
FIG. 10 is a perspective view of an end clip for an apron assembly.

Referring to FIG. 10, according to an exemplary embodiment, the apron assembly 2 includes a plurality of end clips 38 (e.g., retaining members, clamp members, etc.). Each end clip 38 includes an opening that is configured to receive one vertical flange 21 of the apron 1. The end clip 38 also includes two arm members that extend away from the opening of the end clip in opposite directions. As shown in FIG. 2, when the openings of each end clip 38 are received by a vertical flange 21, the arm members of the end clips 38 are configured to interact with the rear support 19 of the apron extension 3. In this way, the end clips 38 may be used to force the rear support 19 of the apron extension 3 against the apron 1. As a result, the end clips 38 may be used to retain the apron 1 within the apron extension 3. The end clips 38 may also be used to restrict horizontal and vertical movement of the apron extension 3 relative to apron 1.

Figure 8:
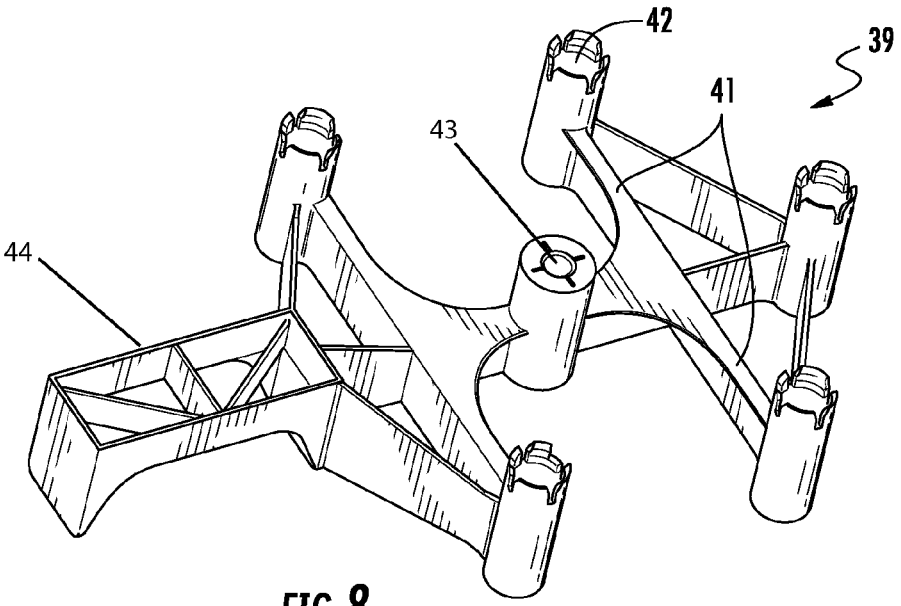
FIG. 8 is a perspective view of an undersupport member wedge piece for an apron assembly.

Referring now to FIGS. 2-3 and 8, according to an exemplary embodiment, the apron assembly 2 includes a plurality of undersupport members 39. Each undersupport member 39 includes a central portion and multiple arm portions 41. The central portion of each undersupport member 39 includes an aperture 43 which is configured to be coupled to a wedge piece 32 and a boss 34 on the bottom surface of the basin 4. In other words, a fastener may be used to couple a wedge piece 32 and an undersupport member 39 to the same boss 34.

According to an exemplary embodiment, the arm portions 41 of each undersupport member 39 extend outward from the central portion. Each arm portion 41 includes an aperture 42, and each aperture 42 may be configured to couple to a boss formed on the bottom surface of the basin 4. A fastener may be used to couple each of the apertures 42 to the bottom surface of the basin 4. According to other exemplary embodiments, a variety of other methods may be used to couple the undersupport member 39 to the basin 4.

According to an exemplary embodiment, each undersupport member 39 may also include an extension 44 that is configured to extend toward the apron 1 when the undersupport member 39 is coupled to the basin 4. The extension 44 of each undersupport member 39 may be positioned beneath a portion of the respective wedge piece 32, when the wedge 32 and undersupport member 39 are coupled to the boss 34 of the basin 4. The extension 44 of each undersupport member 39 may provide further support and stability to each wedge piece 32.

According to an exemplary embodiment, the undersupport members 39 may provide clearance between the basin 4 and the floor when the bathtub 12 is mounted to the floor. The clearance provided between the basin 4 and the floor may be large enough to accommodate an above-floor drain for a bathtub, so that an above floor drain may be coupled to the drain hole 9 of the bathtub 12. According to an exemplary embodiment, the undersupport members 39 may be configured to provide greater stability to the bathtub 12 and to distribute the weight of the bathtub 12 over a greater area of a floor.

According to various exemplary embodiments, a variety of methods may be used to couple the bathtub 12 to a floor when the apron assembly 2 is assembled to the bathtub 12. For example, fasteners or an adhesive may be used to couple a plurality of undersupport members 39 to the floor. According to an exemplary embodiment, a sealing member may be used between the floor and either an apron extension or an extension cover, in order to sealingly couple the apron assembly to the floor.

One skilled in the art will readily appreciate the advantages of the design for the apron assembly 2 described herein. For example, the apron extension 3 and the extension cover 23 may be assembled without the use of tools. Also, the apron 1 is supported along the entire length of the apron extension 3 and the extension cover 23. The integrally formed vertical flanges 21 may be configured to withstand the forces exerted by the wedge pieces 32 and the end clips 38. In addition, an apron assembly may be made from inexpensive materials. For example, the apron extension 3 and the extension cover 23 may be manufactured from a polymeric material using an extrusion process. These are simply some reasons a person skilled in the art of bathtubs will appreciate the various embodiments provided in this disclosure.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apron assembly as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. An apron assembly for a bathtub having an above-floor drain, the apron assembly comprising:

an apron coupled to an upper surface of the bathtub, wherein a bottom end of the apron includes a lip extending outwardly relative to the bathtub in a lateral direction from the bottom end of the apron;

an apron extension configured to couple to the lip of the apron in a snap-fit fashion; and an apron cover configured to couple directly to a front surface of the apron extension in a snap-fit fashion;

wherein the apron extension includes a receiving pocket for receiving the lip to couple the apron extension to the apron.

2. The apron assembly of claim 1, further comprising:

a wedge piece configured to be coupled to a basin of the bathtub, a rear surface of the apron, and a rear surface of the apron extension; and an undersupport member configured to be coupled to a bottom surface of the basin and to provide a clearance for the above-floor drain.

3. The apron assembly of claim 1, wherein a bottom surface of a basin of the bathtub extends below the apron when the apron is coupled to the upper surface of the bathtub.

4. The apron assembly of claim 1, wherein the apron extension is made from an extruded polymeric material.

5. The apron assembly of claim 2, wherein fasteners are not used to couple the apron to either of the apron extension and the wedge piece.

6. The apron assembly of claim 2, wherein the apron extension is made from an extruded polymeric material.

7. The apron assembly of claim 2, wherein a bottom surface of a basin of the bathtub extends below the apron when the apron is coupled to the upper surface of the bathtub.

8. An apron assembly for a basin having an above-floor drain, the apron assembly comprising:

an apron having a height less than or equal to a height of the basin, as measured between a bottom surface of the basin and a rim of the basin, and a lip extending outwardly relative to the basin in a lateral direction from a bottom portion of the apron; and an apron extension configured to couple to the lip when the apron is coupled to the basin;

wherein the apron extension includes a receiving pocket for receiving the lip to couple the apron extension to the apron.

9. The apron assembly of claim 8, further comprising an undersupport member configured to be coupled to a bottom surface of the basin;

wherein the undersupport member provides a clearance between the basin and a floor when the bathtub is mounted to the floor sufficient to enable coupling of the basin to an above-floor drain.

10. The apron assembly of claim 8, wherein the apron extension is made from an extruded polymeric material.

11. The apron assembly of claim 8, wherein the apron is integrally formed with the rim of the basin.

12. The apron assembly of claim 8, wherein the apron extension is configured to couple to the apron in a snap-fit fashion.

13. The apron assembly of claim 8, further comprising an apron cover configured to couple to a front surface of the apron extension in a snap-fit fashion.

14. The bathtub assembly of claim 8, wherein the apron assembly conceals an exterior of the basin from view.

15. A bathtub assembly, comprising:

a basin which is at least partially defined by a bottom wall and a side wall, wherein the basin includes a rim; and an apron assembly comprising:

an apron configured to couple to a portion of the rim, and an apron extension configured to couple to a bottom portion of the apron;

wherein the apron includes a lip extending outwardly relative to the basin in a lateral direction from the bottom portion of the apron; and wherein the apron extension includes a receiving pocket for receiving the lip to couple the apron extension to the apron.

16. The bathtub assembly of claim 15, wherein the apron extension is configured to couple to the apron in a snap-fit fashion.

17. The bathtub assembly of claim 16, wherein the apron assembly conceals an exterior of the basin from view.

* * * * *